US005204175A

United States Patent [19]

Umeda et al.

[11] Patent Number: 5,204,175

[45] Date of Patent: Apr. 20, 1993

[54] WATER ABSORPTIVE FABRIC, AND PROCESS OF PRODUCING THE SAME

[75] Inventors: Masanari Umeda; Yukio Sakuraba, both of Kasugai; Hiroshi Baba, Yokohama, all of Japan

[73] Assignees: Tokai Rubber Industries, Ltd.; Sumitomo Electric Industries, Ltd., Japan

[21] Appl. No.: 711,888

[22] Filed: Jun. 7, 1991

[51] Int. Cl.[5] ..... B32B 27/04; B32B 27/18; B32B 33/00; G02B 6/44; H02G 3/14

[52] U.S. Cl. ..... 428/288; 174/23 C; 174/107; 427/389.9; 427/392; 428/290; 359/100

[58] Field of Search ..... 174/23 C, 107; 385/102, 385/107; 350/96.23; 427/389.9, 392; 428/288, 290

[56] References Cited

U.S. PATENT DOCUMENTS 4,727,097 2/1988 Kobayaski et al. ..... 528/408

FOREIGN PATENT DOCUMENTS 275616 11/1988 Japan .

*Primary Examiner*—James C. Cannon

*Attorney, Agent, or Firm*—Parkhurst, Wendel & Rossi

[57] ABSTRACT

A water absorptive fabric including a layer of a water absorptive polymer whose major components consist of a cross-linked poly(metal salt of acrylic acid) and a water-soluble resin. The fabric may be produced by first impregnating a fabric substrate with a solution which contains a metal salt of acrylic acid in the form of a monomer, a cross-linking agent and a water-soluble resin, and then heating the impregnated fabric substrate to thereby copolymerize the monomer and the cross-linking agent, in the presence of the water-soluble resin.

12 Claims, No Drawings

WATER ABSORPTIVE FABRIC, AND PROCESS OF PRODUCING THE SAME

BACKGROUND OF THE INVENTION

1. Field of the Invention

The present invention relates to a water absorptive fabric, and a process suitable for producing such a water absorptive fabric.

2. Discussion of the Prior Art

A water absorptive fabric is used for various purposes. A water cut-off layer used in a communication cable is one example of application of the water absorptive fabric. Generally, the water absorptive fabric is prepared by impregnating a non-woven fabric substrate with a water absorptive composition containing sodium acrylate monomer and a suitable cross-linking agent, heating the impregnated substrate to thereby polymerize the monomer of the water absorptive composition, and finally drying the substrate. The water absorptive fabric thus prepared has a relatively large water absorbing capacity. Where the fabric is used as the water cut-off layer provided in an optical fiber cable, for example, it is desired that the water absorptive fabric has a sufficiently high coefficient of water absorption or a sufficiently high ratio of hygroscopic swelling or expansion. To this end, the amount of sodium acrylate used for impregnating the substrate is usually increased. However, the increase of the sodium acrylate tends to cause increased hardness of the produced non-woven fabric due to cross-linking of sodium polyacrylate, resulting in reduced flexibility of the fabric, and increased difficulty in bending, folding or otherwise handling the fabric to meet a specific application requirement.

For solving the above drawback, it is proposed to use an elastomer such as ethylene-propylene rubber, together with sodium acrylate. This solution suffers from another drawback, namely, reduction in the degree or ratio of hygroscopic swelling or expansion of the water absorptive fabric, whereby the obtained fabric cannot be suitably used for such applications that require the fabric to be able to swell in a sufficient degree absorbing a large amount of aqueous components.

SUMMARY OF THE INVENTION

It is therefore an object of the present invention to provide a water absorptive fabric which exhibits not only increased degree of hygroscopic swelling or expansion, but also sufficiently high flexibility.

A second object of the invention is to provide a process suitable for producing such a water absorptive fabric.

The first object may be achieved according to one aspect of the present invention, which provides a water absorptive fabric which includes a layer of a water absorptive polymer whose major components consist of a cross-linked poly(metal salt of acrylic acid) and a water-soluble resin.

The second object may be achieved according to another aspect of the present invention, which provides a process of producing a water absorptive fabric, comprising the steps of: impregnating a fabric substrate with a solution which contains a metal salt of acrylic acid in the form of a monomer, a cross-linking agent and a water-soluble resin; and heating the impregnated fabric substrate to thereby copolymerize the monomer and the cross-linking agent, in the presence of the water-soluble resin.

The present invention was developed based on a finding by the inventors as a result of extensive studies in an effort to solve the above-indicated drawback that the flexibility of the water absorptive fabric is deteriorated by an increase in the amount of sodium acrylate monomer with which the non-woven fabric is impregnated. That is, the inventors found that the use of a water-soluble resin together with a metal salt of acrylic acid assures a sufficiently high degree of flexibility of the obtained water absorptive fabric, as well well improved hygroscopic swelling or expansion property of the fabric.

DETAILED DESCRIPTION OF THE INVENTION

The present invention will be described in greater detail.

According to the principle of the present invention, the fabric substrate is impregnated with a solution which includes a metal salt of acrylic acid in the form of a monomer, a cross-linking agent and a water-soluble resin, as described above.

While sodium acrylate is used as a typical example of the metal salt of acrylic acid, the other metal salts of acrylic acid may be used.

The cross-linking agent for cross-linking in the polymer produced by polymerizing the metal salt of acrylic acid may be selected from the group consisting of: methylenebis [acrylamide]; trimethylolpropane trilyacrylate; ethylene glycol diacrylate; polyethylene glycol diacrylate; neopentyl glycol diacrylate; and tetramethylolmethane tetraacrylate. Among these cross-linking agents, methylenebis [acrylamide] is preferably used for improved properties of the water absorptive fabric produced.

Typical examples of the water-soluble resin include: sodium polyacrylate; polyethylene oxide; polyacrylamide; polyvinyl alcohol; water-soluble nylon; polyethyleneimide; polyvinyl pyrrolidone; and copolymer of vinyl pyrrolidone and vinyl acetate. It will be understood that the water-soluble resin used according to the present invention is a highly water-soluble polymer having a high molecular weight.

Suitable other components may be added to impregnate the fabric substrate. For example, a copolymerizing catalyst such as potassium persulfate and benzoyl peroxide may be used as an initiator for copolymerizing the metal salt of acrylic acid and the cross-linking agent.

The selected metal salt of acrylic acid, cross-liking agent and water-soluble resin are mixed together in the form of a solution, and the fabric substrate is impregnated with the prepared solution. While water is generally used as a solvent of the solution, other solvent may be used, provided that the above-indicated components as the solute are dissolved by the solvent. The fabric substrate is generally a nonwoven fabric formed of a synthetic or natural fiber fabric. However, a woven or knit fabric of a natural or synthetic fiber may be used as the fabric substrate.

According to one embodiment of the present invention, the water absorptive fabric may be produced in the following process. Namely, the metal salt of acrylic acid (metal acrylate monomer), cross-linking agent, water-soluble agent, and initiator are dissolved in water, and the fabric substrate such as nonwoven fabric is impregnated with the solution. The impregnated fabric substrate is then placed in a heating device such as a hot blast (hot air) circulating oven, so that the metal acrylate monomer and the cross-linking agent are copolymerized while the fabric substrate is dried. Generally, the solution contains 1–50 parts by weight of the water-soluble resin per 100 parts by weight of the metal salt of acrylic acid in the form of monomer. Where the content of the water-soluble resin is outside the above-specified range, the produced water absorptive fabric does not have desired flexibility.

To further clarify the present invention, there will be described some examples of the present invention, together with a comparative example.

EXAMPLES

The components indicated in Table 1 were mixed in the proportions (parts by weight) indicated in the same table, and individual mixtures were dissolved in water, whereby different solutions were prepared. Then, nonwoven polyester spun bond fabric substrates having a weight of 50 g/m$^2$) were impregnated with the respective solutions, and then kept in a hot blast oven, at 160° C. for five minutes, so that the metal salt of acrylic acid and the water-soluble resin were copolymerized and the substrates were dried. As a result, there were obtained the corresponding water absorptive fabrics (ten specimens according to the invention, and one comparative specimen). Table 1 shows the solid amount in the solutions with which the substrates were impregnated, and the flexibility of the produced fabrics and the ratio of swelling of the fabrics due to water absorption.

TABLE 1

| | EXAMPLES ACCORDING TO THE INVENTION | | | | | | | | | | COMPARATIVE |
|---|---|---|---|---|---|---|---|---|---|---|---|
| Example Nos. | 1 | 2 | 3 | 4 | 5 | 6 | 7 | 8 | 9 | 10 | EXAMPLE |
| Sodium acrylate (Monomer) | 100 | 100 | 100 | 100 | 100 | 100 | 100 | 100 | 100 | 100 | 100 |
| N,N' methylenebis [acryl amide] (Cross-linking agent) | 2 | 2 | 2 | 2 | 2 | 2 | 2 | 2 | 2 | 2 | 2 |
| Potassium persulfate (Initiator) | 0.2 | 0.2 | 0.2 | 0.2 | 0.2 | 0.2 | 0.2 | 0.2 | 0.2 | 0.2 | 0.2 |
| Water-soluble resin | | | | | | | | | | | |
| Polyvinyl pyrrolidone | 0 | 0 | 0 | 0 | 0 | 1 | 10 | 20 | 50 | 70 | 0 |
| Polyethylene oxide | 1 | 10 | 20 | 50 | 70 | 0 | 0 | 0 | 0 | 0 | 0 |
| Water | 200 | 200 | 200 | 200 | 200 | 200 | 200 | 200 | 200 | 200 | 200 |
| Solid amount (g/m$^2$) of solution used to impregnate substrate | 100 | 100 | 100 | 100 | 100 | 100 | 100 | 100 | 100 | 100 | 100 |
| Hygroscopic swelling ratio (after three minutes) | 2.3 | 2.3 | 2.5 | 2.5 | 1.5 | 2.1 | 2.2 | 2.5 | 2.5 | 1.5 | 2.5 |
| Flexibility *1 | C | B | A | A | A | C | B | A | A | A | D |

Note *1
A: Excellent
B: Good
C: Acceptable
D: Poor (Unacceptable)

It will be understood from Table 1 that the specimens (Nos. 1–10) according to the present invention had substantially the same hygroscopic swelling or expansion ratio as the comparative specimen, but exhibited considerable improvement in the flexibility over the comparative specimen.

In the water absorptive fabric prepared according to the principle of the present invention, the cross-linked poly (metal salf of acrylic acid) and the water-soluble resin constitute major components of a water absorptive polymer which has sufficiently high overall flexibility owing to the highly flexible property of the water-soluble resin, which countervails the relatively high hardness of the cross-linked poly (metal salt of acrylic acid). The flexibility of the water absorptive polymer is sufficiently high even where the fabric substrate is impregnated with a relatively large amount of the poly(metal salt of acrylic acid), which assures increased ratio of hygroscopic swelling or expansion of the produced water absorptive fabric. Therefore, the present water absorptive fabric can be easily prepared according to the process described above, and can be suitably used as a water cut-off tape for a optical fiber cable.

While the present invention has been described above, with the presently preferred examples indicated in Table 1, it is to be understood that the invention is not limited to the details of the illustrated examples, but may be embodied with various changes, modifications, which may occur to those skilled in the art, without departing from the spirit and scope of the invention defined in the following claims.

What is claimed is:

1. A water absorptive fabric having sufficient flexibility to be formed about a communication cable which includes a layer of a water absorptive polymeric material formed by the in situ reaction of a metal salt of acrylic acid, a cross-linking agent and a water soluble resin.

2. A water absorptive fabric according to claim 1, wherein said polymeric material is produced by copolymerizing said metal salt of acrylic acid, and a cross-linking agent selected from the group consisting of: methylenebis acrylamide; trimethylolpropane triyacrylate; ethylene glycol diacrylate; polyethylene glycol diacrylate; neopentyl glycol diacrylate; tetramethylolmethane tetraacrylate.

3. A water absorptive fabric according to claim 1, wherein said water-soluble resin is selected from the group consisting of: sodium polyacrylate; polyethylene oxide; polyacrylamide; polyvinyl alcohol; water-soluble nylon; polyethyleneimide; polyvinyl pyrrolidone; and copolymer of vinyl pyrrolidone and vinyl acetate.

4. A process of producing a water absorptive fabric, comprising the steps of: impregnating a fabric substrate with a solution which contains a metal salt of acrylic acid in the form of a monomer, a cross-linking agent and a water-soluble resin; and heating the impregnated fabric substrate to thereby copolymerize said monomer and said cross-linking agent, in the presence of said water-soluble resin.

5. A process according to claim 4, wherein said metal salt of acrylic acid is sodium acrylate.

6. A process according to claim 4, wherein said cross-linking agent is selected from the group consisting of:

methylenebis; trimethylolpropane triacrylate; ethylene glycol diacrylate; polyethylene glycol diacrylate; neopentyl glycol diacrylate; tetramethylolmethane tetraacrylate.

7. A process according to claim 4, wherein said water-soluble resin is selected from the group consisting of: sodium polyacrylate; polyethylene oxide; polyacrylamide; polyvinyl alcohol; water-soluble nylon; polyethyleneimide; polyvinyl pyrrolidone; and copolymer of vinyl pyrrolidone and vinyl acetate.

8. A process according to claim 4, wherein said solution further contains a copolymerizing catalyst as an initiator for copolymerizing said metal salt of acrylic acid and said cross-linking agent.

9. A process according to claim 8, wherein said copolymerizing catalyst consists of potassium persulfate or benzoyl peroxide.

10. A process according to claim 4, wherein said fabric substrate consists of a nonwoven fabric of a synthetic fiber.

11. A process according to claim 4, wherein said fabric substrate consists of a nonwoven fabric of a natural fiber.

12. A process according to claim 4, wherein said solution contains 1–50 parts by weight of said water-soluble resin per 100 parts by weight of said metal salt of acrylic acid.

* * * * *